US005419268A

United States Patent [19]

Fyler et al.

[11] Patent Number: 5,419,268

[45] Date of Patent: May 30, 1995

[54] METHOD AND APPARATUS FOR ASSEMBLING GARMENTS

[75] Inventors: Donald C. Fyler, Needham; James F. Mueller, North Reading, both of Mass.

[73] Assignee: The Charles Stark Draper Laboratories, Inc., Cambridge, Mass.

[21] Appl. No.: 138,774

[22] Filed: Oct. 19, 1993

[51] Int. Cl.[6] ..... D05B 21/00

[52] U.S. Cl. ..... 112/121.15; 112/262.2

[58] Field of Search ..... 112/104, 113, 114, 121.15, 112/121.22, 121.24, 262.1, 265.2, 265.1; 285/18, 21

[56] References Cited

U.S. PATENT DOCUMENTS

| | | | |
|---|---|---|---|
| 2,873,704 | 2/1959 | Bleicher | 112/262.2 X |
| 4,383,491 | 5/1983 | Hodges | 112/262.2 |
| 4,526,115 | 7/1985 | Kosrow et al. | 112/262.3 |
| 4,558,653 | 12/1985 | Horton et al. | 112/262.2 |
| 4,625,665 | 12/1986 | Engle | 112/262.3 |
| 4,633,793 | 1/1987 | Engle | 112/121.11 |
| 4,638,749 | 1/1987 | Wood | 112/121.12 |
| 4,641,827 | 2/1987 | Walton et al. | 271/92 |
| 4,645,193 | 2/1987 | Wood | 271/18.3 |
| 4,957,054 | 9/1990 | Sakuma et al. | 112/262.2 |
| 5,255,621 | 10/1993 | Schramayr et al. | 112/262.2 X |

FOREIGN PATENT DOCUMENTS

| | | | |
|---|---|---|---|
| 3029692 | 2/1988 | Japan | 112/262.2 |
| 0660671 | 6/1987 | Switzerland | 112/262.2 |

*Primary Examiner*—Clifford D. Crowder
*Assistant Examiner*—Ismael Izaguirre
*Attorney, Agent, or Firm*—Lappin & Kusmer

[57] ABSTRACT

A method and apparatus for the automated assembly of sleeves onto the body of the garment. In the present invention, the garment body is placed on a first fixture resembling a mannequin. The sleeves are placed inside facing out on a second conical fixture. Automatically, each sleeve is positioned and sewn onto the garment body and the finished garment is removed from the first fixture. Through the use of sensors, each sleeve is precisely and consistently sewn to the garment body. The result is a high quality garment produced at a lower cost.

37 Claims, 8 Drawing Sheets

METHOD AND APPARATUS FOR ASSEMBLING GARMENTS

BACKGROUND OF THE INVENTION

This invention relates to a method and apparatus for assembling textile items. Specifically, the invention is exemplified in the assembly of sleeve portions on to the body of a garment.

In the current state of the art, the assembly of sleeves onto T-shirts accounts for approximately 50% of the labor cost involved in producing the garment. The sleeves and the body of the garment are produced manually and in a final step the sleeves are manually attached to the body of the garment. In comparison to other operations performed in the industry, a relatively high level of skill is required to attach the sleeves to the garment.

In the prior art method of T-shirt manufacture, the sleeves are pre-fabricated from flat patterns into tubes with the inside facing out and having a finished edge and an unfinished edge. The garment body may be produced from a flat pattern or woven into a tube. The latter is preferred because it results in less waste fabric. The resultant garment body includes a neck opening and shoulder openings. In preparation for attachment of sleeves to the shoulder openings, the garment body is arranged to be right side out.

Typically, the worker (assembler) will align the edge of the sleeve with the edge of the shoulder opening and then manually present the aligned edges to a sewing machine and sew the sleeve to the body of the garment. Typically, the sewing machine used will trim the edges and stitch them together to produce a finished seam.

The prior art method of attaching sleeves to garment bodies requires a relatively high level of skilled labor and is very labor intensive. The cost of finished product is relatively high yet there is still room for improvement in both the level of quality and the level of consistency of the product.

Accordingly, it is an object of the present invention to provide an improved method of assembling garments.

Another object of the present invention is to provide an improved method of assembling garments which is more accurate and reduces waste.

It is another object of the present invention is to provide an apparatus which performs the improved method of assembling garments.

Other objects will in part be obvious and will in part appear hereinafter.

SUMMARY OF THE INVENTION

A significant amount of the skilled labor cost may be eliminated by automating the assembly of sleeves onto the body of a garment. The present invention is directed to a primarily automated method and apparatus for attaching a sleeve element or tube of flexible or limp material to a primary element also of flexible or limp material having an opening therein. The sleeve is attached such that the edge at one end of the sleeve is aligned with the edge of the primary element which defines the opening.

The method is preferably performed by placing the primary element on a support fixture. The sleeve element is placed over the primary element and the edge of the sleeve is aligned with the edge of the opening in the primary element. The edges are then joined in a conventional manner such as sewing, gluing or fusing.

In the preferred embodiment, the primary element may be the body of a garment such as a T-shirt, which is provided with openings at the shoulders. The T-shirt body is initially placed (right side out) on a support fixture having an outer contour nominally similar to the shoulders of a human torso. The sleeves are then placed (inside facing out) over the shoulder portions of the primary element, such that the edge of the sleeve aligns substantially with the edge defining the shoulder openings. The edges are then joined together to form a seam.

The apparatus includes a primary fixture for supporting the primary element. The primary fixture includes a support element for supporting portions of the primary element adjacent to the shoulder openings such that the regions of the primary element adjacent to the openings are generally tubular. An operator or worker would typically place the primary element onto the primary fixture and align the opening with a prescribed location relative to the support element. An operator also places the sleeve element over the outer surface of a secondary fixture having the shape of a conic frustum, thereby, supporting the sleeve from the inside in a generally tubular configuration. A transfer element picks up the sleeve by its outside surface and removes it from the secondary fixture while maintaining the sleeve element in its tubular configuration. While remaining in that configuration, the sleeve is then placed over the primary element on the primary fixture in such a manner as to align the edge of the sleeve with the edge of the opening. The edges are joined and the operator removes the finished article.

In the preferred embodiment, the primary fixture includes two support elements for supporting the shoulder portion of the garment. The support elements include a generally cylindrical array of elongated fingers, which is selectively adjustable, permitting expansion and contraction so that an adjustable radius array is established. When expanded, the fingers may be adjusted to support different size garments in a stretched state. The fingers may be contracted to facilitate placement of the sleeve over the shoulder portions as positioned on the support element. The fingers may also include radially extendible pins which serve to hold the garment in place during the placement of the sleeves over the support elements and hold the sleeve in alignment with the garment while the seam is formed. Each finger may further include an extendible tab which supports the edges during sewing and may be independently retractable to avoid the sewing head.

The secondary fixture is a rotatable wheel having many mandrels projecting radially outward. Each mandrel is substantially in the shape of a conic frustum and approximately the volume of the inside of a sleeve such that the mandrel supports the sleeve's inside surface in a nominally tubular configuration.

The transfer element includes a translatable ring assembly having a plurality of picker elements extending radially inward. The ring assembly is positioned around a mandrel supporting a sleeve and the picker elements are extended and actuated to grasp the sleeve and expand it radially to facilitate removal from the mandrel, while maintaining the sleeve in an expanded tubular configuration. A sensor may be provided to position the picker elements at a predetermined distance from the edge of the sleeve.

The ring assembly then transfers the expanded sleeve to the primary fixture where the fingers contract to reduce the shoulder portion of the garment. The sleeve is placed over the shoulder portion such that the edge of the sleeve aligns with the edge of the opening in the garment when the fingers are expanded. The picker elements release the sleeve and the ring moves away to pickup another sleeve. The array of fingers is then expanded so that the shoulder portion and the overlying sleeve are supported in a two-layer configuration, with the edges-to-be-joined in registration. The extendible pins may be used to hold the garment and the sleeve in alignment and the tabs may be extended to support the edges to be sewn.

The primary fixture is then positioned adjacent the sewing element so that the edges to be joined are presented to a sewing head of a sewing machine. The sewing head then joins the aligned edges to form a seam. The primary fixture rotates about a horizontal axis and moves the edges under the sewing head. Alternatively, the primary fixture may be stationary and the sewing head may be moved circumferentially along the edge.

The process may be automated and monitored through the use of automatic actuators and computers. Each step in the process may be performed by a series of automated mechanisms under computer control. Ideally, operators may be utilized solely to load the component pieces on the primary and secondary fixtures and remove the finished product. Sensors may be employed to precisely monitor each and every operation and insure the quality and consistency of the finished product.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
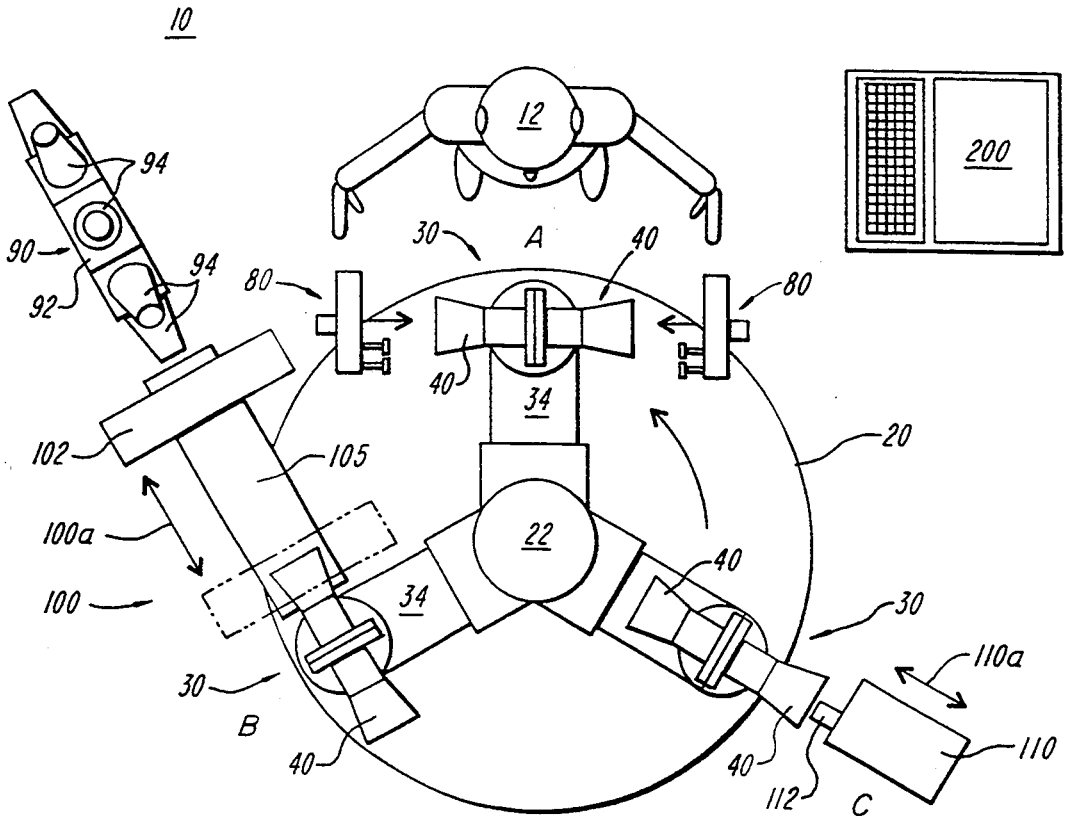
FIG. 1 is a plan view of the preferred embodiment of the present invention.

FIG. 1 shows a three-station system employing the concepts of the present invention to attach the sleeves of a T-shirt onto the garment body. The system 10 includes a turret 20, rotatable about center support 22, having three positions or stations used in performing the process steps of the present invention. Each station includes a fixture 30 for supporting and manipulating the garment body. An exemplary fixture 30 is shown in FIG. 2.

The first station A is a loading and unloading station where an operator 12 places the garment body (not shown) over the first fixture 30. At the second station B, the sleeves (not shown) are transferred from second fixture 90 to the shoulder region of the garment by a translatable ring assembly 102 of a transfer assembly 100. At the third station C, the edges of the sleeve and the opening in the garment body are sewn together to form a seam. It should be noted that the process need not be embodied in rotary or circular configuration. The steps are equally well suited to be embodied in a linear, assembly line type configuration as well.

Figure 2:
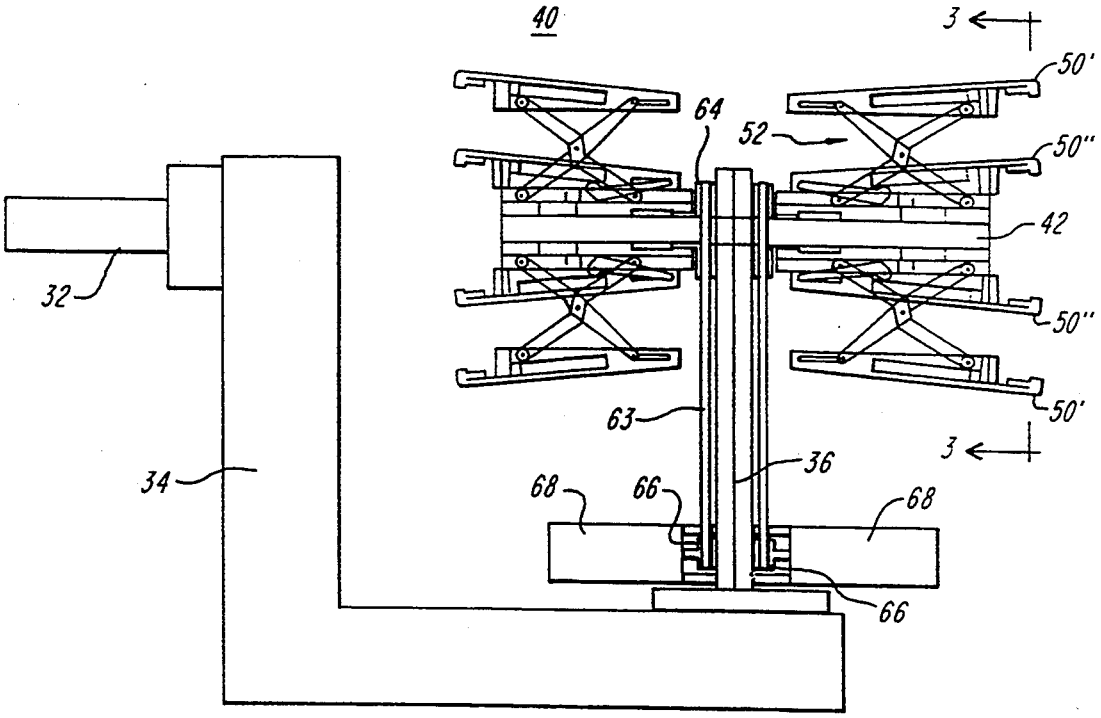
FIG. 2 is a side elevation view of the primary fixture of the embodiment shown in FIG. 1.

As shown in FIG. 2, the fixture 30 is supported by a support arm 34 which is rotatable about a horizontal axle 32. The support arm 34 is rotatable about a horizontal axis by mounting axle 32 upon center support 22 of rotatable turret 20. A pair of expandable/contractible garment shoulder supports 40 are mounted on the top of vertical supports 36. The pair of shoulder supports 40 establish a means for positioning the shoulder portion of a garment (such as a T-shirt body) in the nominal position of the shoulders of a human torso.

The vertical support 36 is rotatable about a vertical axis on support arm 34 to permit placing and sewing a sleeve onto each of the shoulder supports 40. The shoulder supports 40 include a horizontal support spindle 42 which support and manipulate the shoulder portions of the garment body. When aligned, both axle 32 and horizontal support spindle 42 extend substantially along the same horizontal axis. Each support spindle 42 preferably includes a plurality of elongated fingers 50 which are equally spaced around the support spindle 42 in a generally cylindrical array. Am adjustable scissor linkage 52 couples the fingers 50 to spindle 42 so that the radius of the array may be adjusted.

Figure 3:
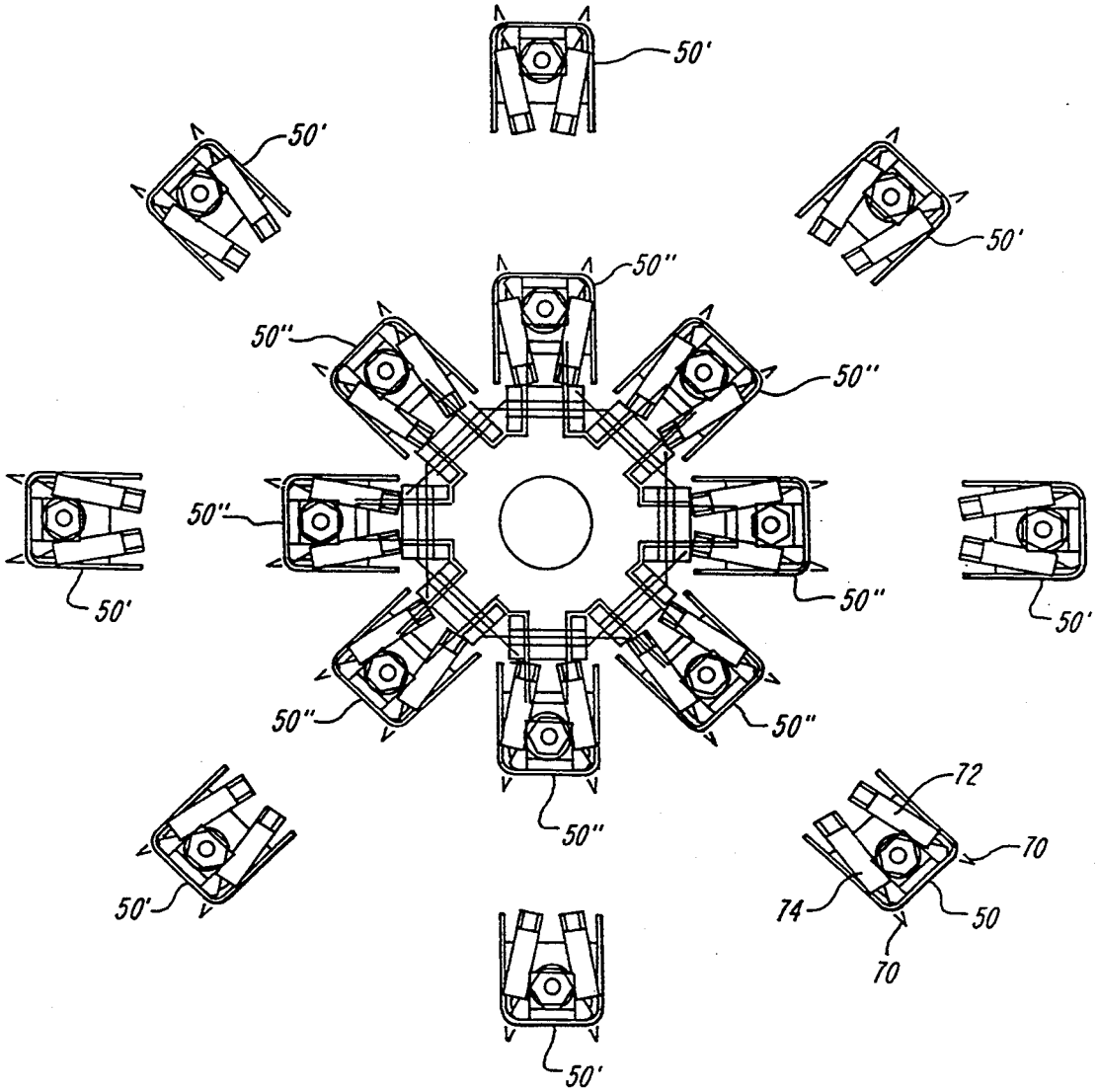
FIG. 3 is a detail sectional view of the fingers shown in FIG. 2.

As shown diagrammatically in FIG. 3, the fingers 50 are radially expandable 50' to accommodate garments of different sizes and are radially contractible 50'' to facilitate placement of the sleeve portions over the shoulder portion in preparation of aligning the edges to be joined. Each finger 50 includes a pair of pins 70 which are extendible and retractable by actuators 72. In the retracted position, the pins 70 are below the outer surface of the finger 50. In the extended position, the pins 70 project beyond the outer surface of the finger 50 at an oblique angle to each other. In the preferred embodiment, the distance between the ends of the pins 70 increases as they are extended such that when the pins 70 engage the garment material as they are extended, a tension in the material is formed between the pins 70 which holds the material on the pins 70. With the pins 70 extended and the material held in this manner, the fingers 50 may contract to reduce the volume of the garment to facilitate placement of the sleeve over the garment body. Each finger 50 also includes a tab 74, also extendible and retractable by an actuator (not shown). The tabs 74 extend parallel to support spindle 42 and provide support for the edges during the sewing operation. The tabs 74 are retracted during sewing to clear the sewing head.

Figure 5:
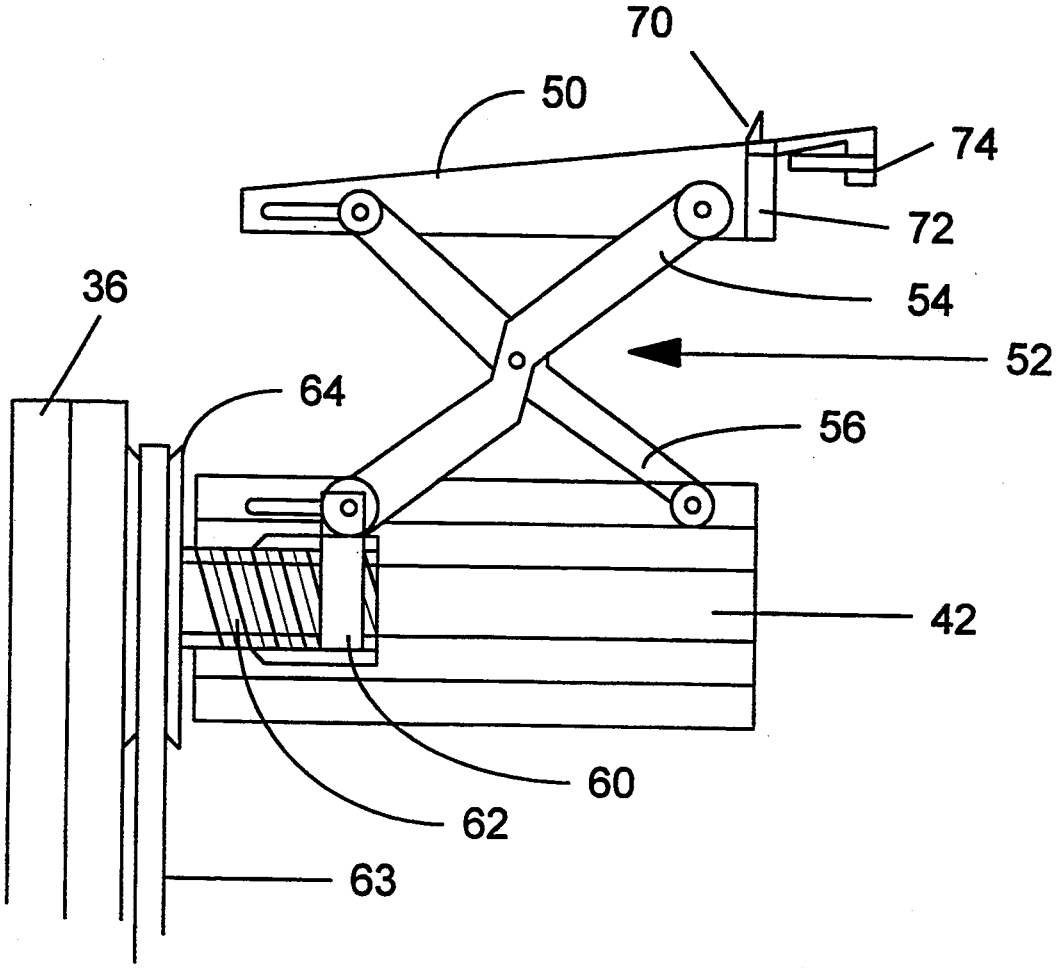
FIG. 5 is a detail view of the fingers and the garment support.

As shown in FIG. 5, each finger 50 is expanded and contracted by scissor linkage 52 on support spindle 42 which extends transverse to vertical support 36. The scissor linkage 52 includes a first link 54 pivotally attached to finger 50 at an outer end and slidably attached to support spindle 42 at an inner end. The scissor linkage 52 also includes a second link 56 pivotally attached to support spindle 42 at an outer end and slidably attached to finger 50 at an inner end. The first link 54 is pivotally connected to second link 56 at a position proximate the middle of each link. The support spindle 42 carries a drive screw 62 which is rotatable thereon. The drive screw 62 is fixed to upper drive pulley 64 and driven by drive belt 63. The drive belt 63 is driven by lower drive pulley 66 and drive motor 68 carried on the lower portion of vertical support 36. The second link 56 carries a drive cam 60 which engages the drive screw 62. When the drive screw 62 is turned in a first direction, the cam 60 is forced outward causing the scissor linkage 52 to open and finger 50 to expand. When the drive screw 62 turns in the reverse direction, the cam 60 is pulled inward causing the scissor linkage 52 to contract.

In operation, when the garment is placed on first fixture 30, it is desirable to align the edges of the opening in the garment with the fixture. As shown in FIG. 1, opening alignment elements 80 may be employed to accurately position the edges of the opening in the garment on the first fixture 30 in preparation for placement of the sleeves. This may be achieved by lifting the edge of the garment off the pins 70, positioning the edge at the proper location and placing the edge back down on the pins.

As shown in FIG. 1, the second fixture 90, includes a wheel 92 rotatable about a horizontal axis. The outer perimeter of the wheel 92 includes eight equally spaced conic frustum shaped mandrels 94 for supporting sleeves (not shown). Each mandrel 94 is tapered to accommodate sleeves of different sizes and to facilitate removal by the sleeve transfer system 100. In other embodiments, the mandrels 94 may be cylindrical.

Figure 4:
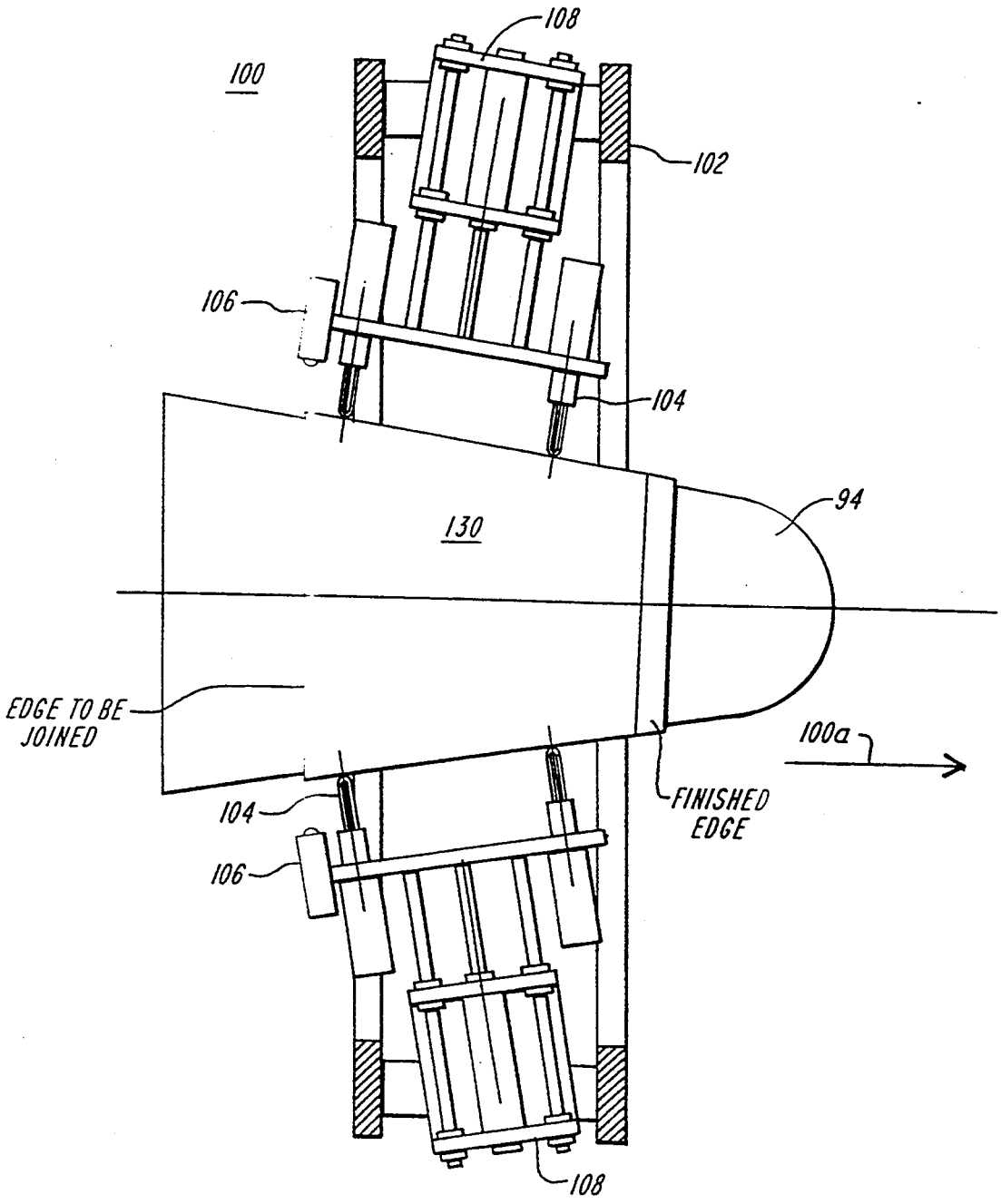
FIG. 4 is a detail sectional view of the transfer ring and picker elements.

As shown in FIG. 1, the sleeve transfer system 100 includes a translatable ring assembly 102, which is moveable in the direction indicated by arrow 100*a*. Assembly 102 moves horizontally along rail 105 by means of actuator (not shown). The translatable ring 102 includes six pair of pickers 104 equally spaced around the ring 102 for extending radially inward to grasp a sleeve 130 from a sleeve mandrel 94. As shown in FIG. 4, each pair of pickers 104 is positioned on ring 102 in a spaced apart configuration by a picker support 108. The picker support may angle each pair of pickers 104 to align them with the taper of the sleeve mandrel 94. The picker support 108 may also include an edge sensor 106 to enable the ring 102 to be positioned at a predetermined distance relative to the edge of the sleeve 130.

The picker may be any suitable device capable of selectively grabbing and releasing a fabric or other limp material. Common picker devices include vacuum pickup and pinchers. The preferred picker device is disclosed in U.S. Pat. No. 4,645,193. This pickup device includes a pair of parallel plates having oppositely directed teeth. The teeth are pressed into the material and the plates are moved laterally such that the teeth engage the material and form a tension between the plates which holds the material on the teeth.

The sleeve is sewn onto the garment body at the sewing station C using a sewing machine 110 having a sewing head 112. The sewing machine 110 is movable toward and away from first fixture 30, as indicated by arrow 110*c* in FIG. 4. The fingers 50 are expanded to stretch the edges to facilitate insertion over the sewing head. Tabs 74 are extended to support the edges during sewing. As first fixture 30 is rotated about axle 32, the tabs 74 are retracted so as not to interfere with the sewing head. The sewing machine is of the conventional type used to attach sleeves to garments manually. The machine may trim excess material as the seam is formed.

The apparatus of the present invention may be used manually to assemble T-shirts. For example, after the garment is placed on the first fixture in station A, the turret may be turned manually to station B where the sleeve is manually placed over the shoulder of the garment and edges aligned. The turret may then be moved to station C where the sewing machine is moved into place and first fixture is manually turned while the seam is formed.

It is desirable to provide a controller and actuators to move the apparatus automatically. The controller 200 such as a conventional programmable controller or microcomputer may be used to coordinate the sequence of steps necessary with a minimum of human intervention. Conventional servo motors and solenoids may be used to actuate the turret, first fixture, second fixture, translatable ring and sewing station. Alternatively, pneumatic or hydraulic actuators may also be used in conjunction with the controller to articulate the elements of the apparatus.

In the preferred embodiment, the turret may be a conventional rotary indexing table. The first fixtures may be actuated about the horizontal axis by servo motors and rotated about the vertical axis by either servo motors or an indexed drive. The drive motors 68 may be servo motors. The extendible pins and tabs may be actuated by pneumatic cylinders. The sleeve mandrel may be actuated by an indexed drive or a servo motor.

The transfer system includes a transfer ring 102 which may be suspended from a linear track and actuated by a linear motor. Another suitable method of actuating the transfer ring includes a drive belt and pulley system. The transfer ring 102 may also be utilized as the end effector on a robotic arm.

It is also desirable to provide alignment elements 80 to automatically align the edges of the garment body on the first fixture. This may be achieved by a 2 axis robotic arm mounted to rotate about a horizontal axis substantially aligned with the axis support spindle 42. The end effector may include an optical sensor to detect the edge of the garment body and a gripper to lift the edge portion off the pins of the fingers, reposition it and replace it on the pins of the fingers.

The sewing machine may be a conventional overedge sewing machine. The preferred stitch is the overedge stitch type 504. It is preferable that the speed of the machine is controlled and position of the needle is fed back to the controller to coordinate the movements of the material with the sewing machine to insure uniform stitches and avoid damaging the needle. It is also preferable that the pressure foot be modified to have a higher lift and reduced foot pressure since the material is fed by the movement of the first fixture. A cutter may be provided to cut the thread after the seam is completed. For example, the cutter may be a solenoid actuated scissors which cuts the thread as the sewing station move away from the garment.

In an alternative embodiment, the first fixture may be stationary and the sewing machine or the just the sewing head may be moveable in circular fashion to form the seam. For example the sewing head may be mounted on a robotic arm to move it through the area necessary to sew the edges.

Figure 6A:
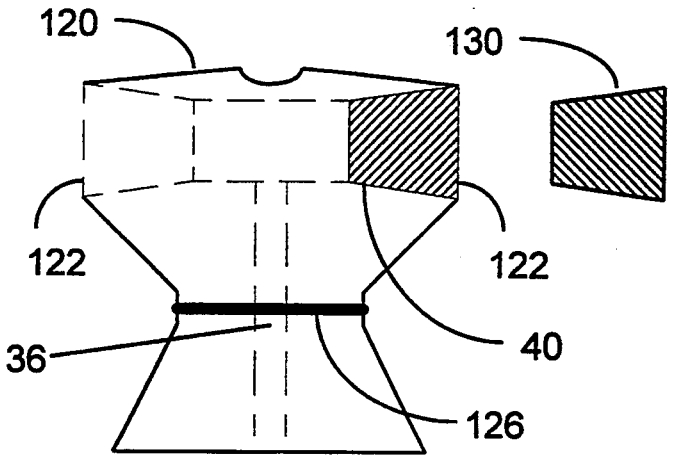
FIGS. 6A–6E are a diagrammatic representation of the process of attaching the sleeve to the garment body
Figure 6B:
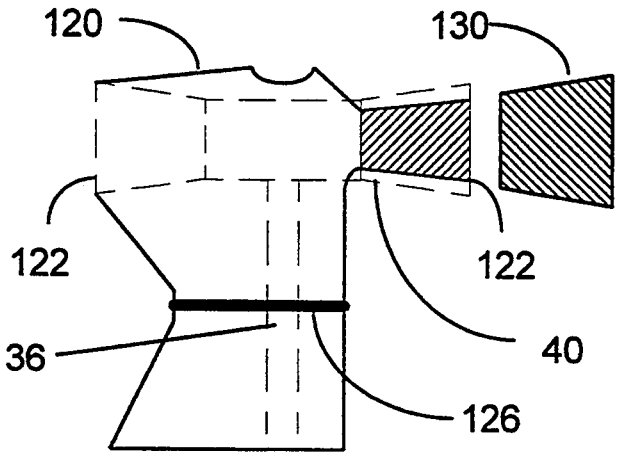
Figure 6C:
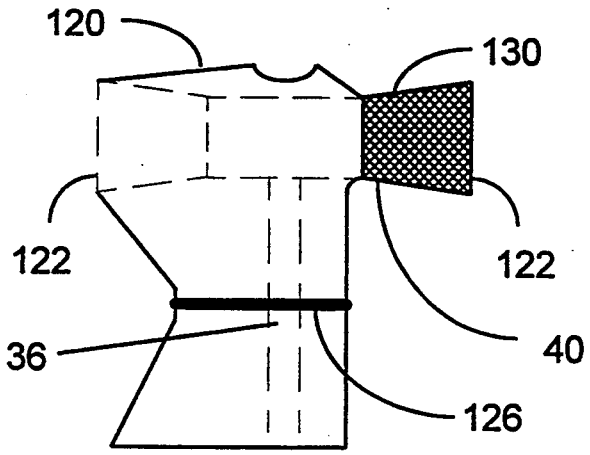
Figure 6D:
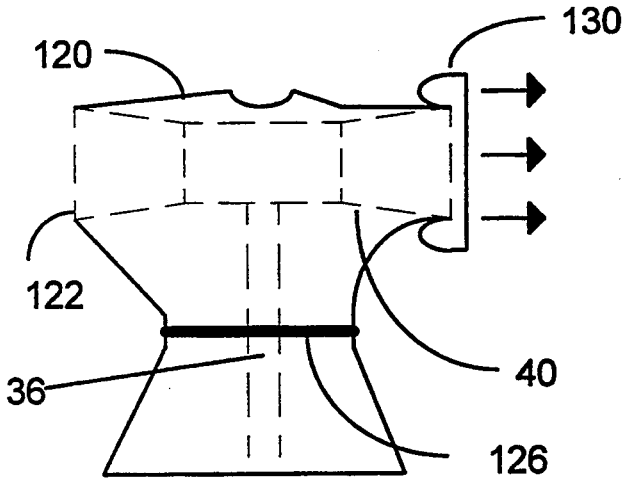
Figure 6E:
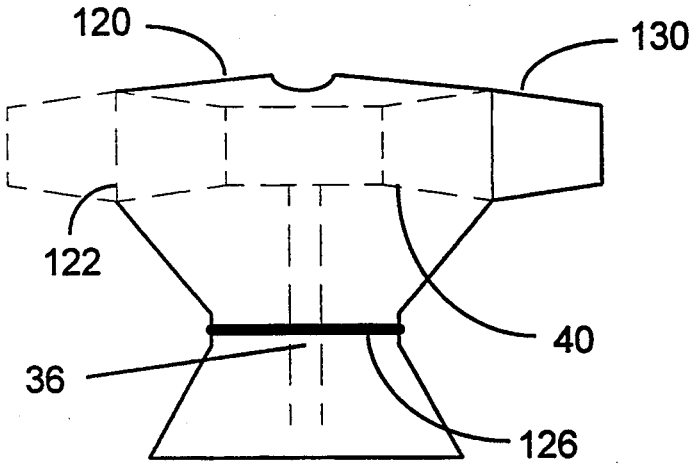

The process may be best exemplified in the assembly of the sleeves on the body of a T-shirt as shown in FIGS. 6A through 6E. FIG. 6A shows the T-shirt body 120 supported on garment support 40 of fixture 30. The garment support 40 maintains the hole 122 in the garment body in a substantially open position. The adjacent material forms a substantially tubular shoulder portion and an elastic cord or string 126 may be used to pull the lower portion of the garment body in around the vertical support 36. As shown in FIG. 6B, the portion of support 40 underlying the upper right (as shown) shoulder portion is reduced in diameter to facilitate positioning of the sleeve portion 130 is over the shoulder portion so that both are supported by garment support 40 as shown in FIG. 6C. The edges defining hole 122 are sewn together to form a seam. As shown in FIG. 6D, the sleeve is turned right side out as it is rolled off the shoulder portion, thus hiding the seam inside the garment. The finished garment is shown in FIG. 6E.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. An apparatus for attaching a first flexible element to a second flexible element, said first flexible element having a first opening defined by a first edge of said first flexible element, said second flexible element being tubular and having a second opening defined by a second edge of said second flexible element and a third opening defined by a third edge of said second flexible element, said apparatus comprising:

first fixturing means for supporting said first flexible element whereby a portion of said first flexible element adjacent to said first edge is substantially tubular, transfer means disposed about a region, for supporting said second flexible element in a substantially tubular configuration within said region, including means for positioning said transfer means with respect to said first fixturing means and for positioning said transfer means to overlie at least a portion of said first fixturing means whereby said second flexible element overlies at least a portion of said first flexible element with said first and second edges being mutually adjacent, and edge joining means for joining said first edge to said second edge.

2. An apparatus according to claim 1 wherein:

said first fixturing means includes at least one supporting means for selectively expanding and contracting said tubular portion of said first flexible element, and said supporting means includes a plurality of support elements for supporting said first flexible element and means for selectively expanding and contracting said plurality of support elements and said tubular portion of said first flexible element.

3. An apparatus according to claim 2 wherein:

said supporting means is rotatable about a horizontal axis and a vertical axis.

4. An apparatus according to claim 2 wherein said support means includes an axis and each of said support elements includes a radially expandable and contractible finger substantially equally positioned around said axis.

5. An apparatus according to claim 4 wherein each of said radially expandable and contractible fingers includes engaging means for grasping said first flexible element.

6. An apparatus according to claim 4 wherein each of said radially expandable and contractible fingers includes extensible tab means for supporting said first edge.

7. An apparatus according to claim 6 wherein each of said radially expandable and contractible fingers includes extendible tab means for selectively supporting portions of said first edge.

8. An apparatus according to claim 6 wherein said extendible tab means comprises a pin extendible along an axis substantially parallel to said axis of said support means.

9. An apparatus according to claim 6 wherein each of said fingers includes a longitudinal axis substantially parallel to said axis of said support means and each of said extensible tab means comprises a pin extendible along said longitudinal axis.

10. An apparatus according to claim 2 wherein said support means includes an axis and said plurality of support elements includes eight radially extensible and contractible fingers substantially equally positioned around said axis.

11. An apparatus according to claim 10 wherein each of said radially expandable and contractible fingers includes engaging means for grasping said first flexible element.

12. An apparatus according to claim 11 wherein said engaging means includes at least one radially extensible and contractible pin.

13. An apparatus according to claim 12 wherein each of said radially extendible and contractible pins moves in a direction not parallel to the direction said fingers radially extend and contract along.

14. An apparatus according to claim 1 further comprising a second fixturing means for supporting said second flexible element in a substantially tubular configuration, and said second fixturing means including at least one second support means for holding said second flexible element.

15. An apparatus according to claim 1 further comprising a second fixturing means for supporting said second flexible element in a substantially tubular configuration, and said second fixturing means including a plurality of second support means for holding said second flexible element.

16. An apparatus according to claim 15 wherein said second fixturing means includes an axis and said second support means are substantially equally spaced around said axis.

17. An apparatus according to claim 16 wherein said second support means are rotatable about said axis.

18. An apparatus according to claim 1 further comprising a second fixturing means for supporting said second flexible element in a substantially tubular configuration, and said second fixturing means including second support means for supporting said second flexible element on an inside surface of said second flexible element.

19. An apparatus according to claim 18 wherein said second support means have a substantially cylindrical outer surface.

20. An apparatus according to claim 1 wherein said transfer means includes grasping means for grasping said second flexible element and transporting means for moving said grasping means with respect to said first fixturing means.

21. An apparatus according to claim 20 wherein said grasping means includes a plurality of picking means for grasping a portion of said second flexible element, said picking means being arranged in a circular configuration.

22. The apparatus according to claim 20 wherein said grasping means includes sensing means for sensing an edge of a flexible element.

23. An apparatus according to claim 1 wherein the apparatus further includes control means for controlling the movements of any of said first fixturing means, said transfer means and said edge joining means.

24. An apparatus according to claim 23 wherein said control means further includes a general purpose microcomputer.

25. An apparatus for attaching a first garment element to a second garment element, said first garment element having a first opening defined by a first edge of said first garment element, said second garment element being substantially in the form of a sleeve and having a second opening defined by a second edge of said second flexible element and a third opening defined by a third edge of said second flexible element, said apparatus comprising:

at least one first garment support fixture for supporting said first garment element, whereby a portion of said first flexible element adjacent to said first edge is substantially tubular, said first garment support fixture including at least one shoulder support means for selectively expanding and contracting said tubular portion of said first garment element, said shoulder support means including a plurality of support surfaces, expandable and contractible with respect to a common axis, for supporting said first garment element and for expanding and contracting said tubular portion of said first garment element, a garment pickup ring comprising a circular array of garment picking elements substantially disposed about a void region for grasping said second garment element and maintaining said second garment element in a substantially tubular configuration within said void region, and positioning said second garment element to surround at least a portion of said tubular portion of said first garment and said shoulder support, a pickup transfer element including means for positioning said garment pickup ring with respect to said shoulder support means whereby said garment pickup ring overlies at least a portion of said shoulder support means, a seam forming element for joining said first edge to said second edge.

26. The apparatus according to claim 25 wherein said first garment support element includes two shoulder support elements for supporting the shoulders of a garment body, and said first garment support element being rotatable about a first horizontal axis and rotatable about a first vertical axis.

27. The apparatus according to claim 26 wherein each of said shoulder support element extends along a second horizontal axis which lies on the same horizontal plane as said first horizontal axis.

28. The apparatus according to claim 26 wherein each of said shoulder support elements extend transverse to and radially outward from said first vertical axis.

29. The apparatus according to claim 26 wherein each of said fingers are mounted on a support spindle and includes a pair of pins having ends which are extendible radially from said support spindle at an oblique angle relative to each other such that the distance between said ends increases as said ends are extended.

30. The apparatus according to claim 26 further comprising:

a rotatable turret for supporting three first garment fixtures and for rotating said garment fixtures to three stations.

31. The apparatus according to claim 26 further comprising:

a controller for controlling the movements of any of said first fixturing element, said transfer element, said garment pickup ring and said seam forming element.

32. The apparatus according to claim 31 wherein:

said controller includes a general purpose microcomputer.

33. A method of attaching a first flexible element to a second flexible element, said first flexible element having a first opening defined by a first edge of said first flexible element, said second flexible element being substantially tubular and having a second opening defined by a second edge of said second flexible element and a third opening defined by a third edge of said second flexible element, said method comprising the steps of:

positioning at least a portion of said second flexible element over a portion of said first flexible element, positioning said second flexible element such that said second edge is adjacent said first edge, attaching said first flexible element to said second flexible element at a position adjacent said first edge.

34. The method according to claim 33 further comprising the steps of:

placing said first flexible element on a first fixture element, placing said second flexible element on a second fixture element.

35. The method according to claim 34 further including the step of:

providing means for automatically transferring said second flexible element from said second fixture element to said first fixture element.

36. An apparatus according to claim 24 further comprising a second garment support fixture for supporting said second garment element in a substantially tubular configuration, and wherein said pickup transfer element is translatable with respect to said second garment support fixture to a position where said garment pickup ring can grasp a second garment element supported by said second garment support fixture and translatable with respect to said first garment support fixture to a position where said garment pickup ring can position said second garment element over said first garment element and said shoulder support means.

37. The apparatus according to claim 24 wherein said garment pickup ring includes sensing means for sensing an edge of a flexible element and for generating a signal indicating the presence of said edge.

* * * * *